US006950095B2

(12) United States Patent
Kim et al.

(10) Patent No.: US 6,950,095 B2
(45) Date of Patent: Sep. 27, 2005

(54) APPARATUS AND METHOD FOR INPUTTING AND DISPLAYING DATA FOR REFRIGERATOR

(75) Inventors: Tae-Young Kim, Changwon Gyeongnam (KR); Jong-Jin Kim, Changwon Gyeongnam (KR); Jae-Moon Kang, Jinhae Gyeongnam (KR)

(73) Assignee: LG Electronics Inc., Seoul (KR)

( * ) Notice: Subject to any disclaimer, the term of this patent is extended or adjusted under 35 U.S.C. 154(b) by 505 days.

(21) Appl. No.: 09/881,673

(22) Filed: Jun. 18, 2001

(65) Prior Publication Data

US 2002/0003531 A1 Jan. 10, 2002

(30) Foreign Application Priority Data

Jun. 19, 2000 (KR) ..... 2000-33681
Jun. 19, 2000 (KR) ..... 2000-33682

(51) Int. Cl.[7] ..... G09G 5/00; F25B 49/00

(52) U.S. Cl. ..... 345/173; 345/544; 62/126; 700/17

(58) Field of Search ..... 345/173, 544; 62/125, 126; 700/17

(56) References Cited

U.S. PATENT DOCUMENTS 4,935,730 A * 6/1990 Kosuka ..... 345/544
5,063,600 A * 11/1991 Norwood ..... 382/186
5,675,363 A * 10/1997 Omori ..... 345/544
5,831,664 A * 11/1998 Wharton et al. ..... 725/81
6,134,637 A * 10/2000 Toda ..... 711/165
6,179,214 B1 * 1/2001 Key et al. ..... 236/51
6,236,396 B1 * 5/2001 Jenson et al. ..... 345/764
6,359,270 B1 * 3/2002 Bridson ..... 219/679
6,550,681 B1 * 4/2003 Ross et al. ..... 235/462.13
2002/0016734 A1 * 2/2002 McGill et al. ..... 705/14

* cited by examiner

*Primary Examiner*—Xiao Wu
*Assistant Examiner*—M. Fatahiyar
(74) *Attorney, Agent, or Firm*—Fleshner & Kim, LLP

(57) ABSTRACT

The present invention relates to an apparatus and method for inputting and displaying data for a refrigerator, and more particularly, to an apparatus and method for inputting and displaying data for a refrigerator wherein various data can be inputted and displayed in the form of images using a touchscreen. To this end, in the present invention the input and display of the characters are not made in a manner that the characters for forming the data are inputted but made in the form of the images corresponding to the characters. Thus, the input and display of the data can be performed regardless of the languages, and the regions and countries where the refrigerators are used. Accordingly, the present invention has an advantage in that the information on various data can be conveniently obtained without limitations on the function, used time and language for inputting the characters.

23 Claims, 5 Drawing Sheets

APPARATUS AND METHOD FOR INPUTTING AND DISPLAYING DATA FOR REFRIGERATOR

FIELD OF THE INVENTION

The present invention relates to an apparatus and method for inputting and displaying data for a refrigerator, and more particularly, to an apparatus and method for inputting and displaying data for a refrigerator wherein various data can be inputted into and displayed on the refrigerator in the form of images using a touchscreen.

BACKGROUND OF THE INVENTION

In order to maintain freshness of foods to be stored in the some refrigerators, a separate freshness-retaining chamber has been prepared so that users can use it selectively. In general, various kinds of the foods have been stored in these refrigerators. However, since the users cannot keep the kinds of the stored foods in mind without omission, they should unnecessarily open and close a door of the refrigerator in order to confirm as to what kinds of the stored foods has been stored in the refrigerator. By confirming the foods stored in the refrigerator in this way, unnecessary consumption of electric energy due to the opening and closing of the door has been produced. In addition, since the foods are spoiled in a case where they are still stored even after a storage period has been passed, waste of the foods has been often produced.

In order to solve the above problems, a refrigerator in which internal foods stored therein can be confirmed from the outside of the refrigerator has been disclosed in FIG. 1.

As shown in FIG. 1, the conventional refrigerator comprises a microcomputer 10 which includes a ROM for recording kinds, quantities and storage periods of contents, a RAM, and a timer in order to control a system capable of confirming and monitoring information on the kinds of the foods stored in the refrigerator from the outside, and a microcomputer enable portion 30 for applying a pulse to the microcomputer to successively increase an address. Further, it comprises a selective input portion 50 for inputting information of the contents, such as kinds, quantities and storage periods of the contents, into the RAM of the microcomputer 10. Furthermore, the conventional refrigerator comprises a data buffer 60 and an address decoder 70 that transmit information on the contents and addresses of the microcomputer 10 to a display portion 80, respectively.

Accordingly, in the conventional refrigerator, the kinds of the contents and the like displayed on the display portion 80 can be confirmed by pressing down a toggle switch SW2 of the microcomputer enable portion 30 of the microcomputer, when the users intend to confirm information on the contents themselves and on the kinds, quantities and storage periods of the contents, which is recorded in the RAM of the microcomputer 10, from the outside of the refrigerator.

That is, when the toggle switch SW2 is pressed down after the microcomputer 10 has been initialized by pressing down a reset switch SW3 of a reset portion 40, address data A0–A15 of a first address are decoded to the decoder 70 and inputted into the display portion 80. Subsequently, data D0–D7 of the relevant address recorded in the RAM pass through the buffer 60; and the kinds, quantities and storage periods of the relevant contents are then displayed on the display portion 80.

Through these processes, the conventional refrigerator has been used in such a manner that information on the contents put into the refrigerator are stored into a memory and shared with all the users. Further, in the conventional refrigerator constructed as such, the foods stored in the refrigerator can be confirmed from the outside without unnecessarily opening and closing the door of the refrigerator.

On the other hand, a plurality of food groups stored in the conventional refrigerator are displayed on the display portion 80 which has been set in a state that information on the food groups has been already inputted and stored.

That is, in order to input the information on the stored foods into the RAM of the microcomputer 10, the conventional refrigerator has utilized a plurality of keys provided on the selective input portion 50, as shown in FIG. 2. The selective input portion 50 includes an input key 50*a*, an arrow key 50*b*, a select key 50*c*, a delete key 50*d*, etc.

The input of specific characters through the selective input portion 50 constructed as such is performed by the following process. When an apple, as an example, is to be stored in a refrigerating chamber, a character screen is displayed on the display portion 80 by selecting the input key 50*a*. On the character screen to be displayed at this time, a keyboard for the characters (consonants and vowels of the Korean or English alphabets) that has been already set in accordance with regions and countries where the refrigerators are used are displayed.

Thereafter, the user moves a cursor to a position of a desired character among the keyboard for the characters displayed on the display portion 80 by using the arrow key 50*b*, and then creates the character "apple" by selecting the select key 50*c*. On the other hand, when the character has been erroneously created, the user again moves the cursor to the desired position by using the arrow key 50*b* and deletes the erroneous character by using the delete key 50*d*.

Accordingly, in the conventional refrigerator, recording of information or data on the stored foods through the selective input portion 50 should have been performed whenever the foods have been put into and stored in the refrigerator. However, since this recording should pass through the processes of creating the desired characters by successively selecting them, inputting and storing the characters, there was a problem in that it takes a long time to record the characters.

That is, in a case of the character "apple," the alphabets such as "a," "p," "p," "l," and "e" should be successively selected. Further, whenever the respective alphabets are selected, the procedures for inputting or touching the arrow key 50*b* and the select key 50*c* should be performed. Further, if the erroneous inputs occur during the procedures, several keys such as the arrow key 50*b* and the delete key 50*d* should be used over and over. Therefore, there was also a problem in that the procedures are troublesome and time-consuming.

Moreover, since the display portion 80 provided on the refrigerator is made a small screen, it was difficult to input the characters into the display portion and correct the characters thereon. Due to this difficulty, use of a function for displaying the information on the stored foods cannot be sufficiently induced. Consequently, there was a problem in that the display function becomes an unnecessary one.

In addition, since the keyboard for the characters suitable to the countries or regions where the conventional refrigerator is used should be displayed on the display portion, character displays for all kinds of the languages should be able to be made in the refrigerator to be sold. Therefore, there was a problem in that the above causes capacity of a memory device for storing the characters to be expanded and manufacturing costs of the refrigerator to be increased.

SUMMARY OF THE INVENTION

Therefore, the present invention provides an apparatus wherein information on stored foods can be conveniently inputted or stored in the form of images, which a user has written or drawn on a touchscreen, instead of directly inputting characters by the user. Further, the present invention proposes an apparatus by which the information on the stored foods can be displayed regardless of kinds of the languages. Furthermore, the present invention proposes an apparatus by which the characters regarding the schedules or data for daily life can be inputted and displayed in the form of the images.

That is, in the present invention, since character input and display are not made in a manner that the characters for forming the data are inputted but are made in the form of the images corresponding to the characters, the input and display of the data can be performed regardless of the specific languages, and the regions and countries where the refrigerators are used.

Accordingly, a first object of the present invention is to provide an apparatus and method for inputting and displaying data for a refrigerator wherein the data can be inputted to and displayed on the refrigerator in the form of images that a user has written or drawn on a touchscreen.

A second object of the present invention is to provide an apparatus and method for inputting and displaying data for a refrigerator wherein information on foods stored in the refrigerator can be displayed using a touchscreen.

A third object of the present invention is to provide an apparatus and method for inputting and displaying data for a refrigerator wherein home schedules or daily life data can be displayed on the refrigerator using a touchscreen.

In order to achieve the above objects of the present invention, there is provided an apparatus for inputting and displaying data for a refrigerator, comprising: a touchscreen mounted on a front surface of the refrigerator for inputting the data in the form of images that a user has written or drawn; a memory means for storing the image data written or drawn on the touchscreen; and a control means for performing control of displaying the image data stored in the memory means on the touchscreen or of storing the image data, which are inputted through the touchscreen, into the memory means.

There is also provided an apparatus for inputting and displaying data for a refrigerator, comprising: a touchscreen mounted on a front surface of the refrigerator for inputting information on foods stored in the refrigerator in the form of images; a memory means for storing the image data on the stored foods inputted through the touchscreen; and a control means for performing control of displaying the image data on the stored foods, which are stored in the memory means, on the touchscreen or of storing the image data on the stored foods, which are inputted through the touchscreen, into the memory means.

The memory means according to the present invention may stores the image data on the stored foods into storage areas which are divided into ones respectively corresponding to a plurality of food storage chambers provided in the refrigerator.

Further, in order to achieve the above objects of the present invention, there is provided a method for inputting and displaying data for a refrigerator in which a touchscreen is mounted on a front surface of the refrigerator and data storage area divided into ones respectively corresponding to a plurality of food storage chambers in the refrigerator are allocated. The method comprises the steps of: displaying the plurality of the food storage chambers on the touchscreen; selecting an arbitrary food storage chamber among the food storage chambers displayed on the touchscreen; inputting information on foods stored in the refrigerator in the form of image data through the touchscreen; and storing the image data on the stored foods into the data storage areas corresponding to the selected food storage chambers.

The image data on the stored foods which are stored in the data storage areas corresponding to the respective food storage chambers may be simultaneously displayed, when the food storage chambers are displayed in the displaying step.

The method according to the present invention may further comprise a step of selecting some image data to be deleted from the image data on the stored foods displayed on the touchscreen and deleting the selected image data.

Furthermore, in order to achieve the above objects of the present invention, there is provided a method for inputting and displaying data for a refrigerator with a touchscreen mounted on a front surface thereof, comprising the steps of: monitoring touch action of a user made on the touchscreen; when a schedule management function is touched through the touchscreen, displaying a calendar corresponding to a relevant month on the touchscreen; when a specific date region of the displayed calendar is touched, providing an input screen for inputting image data on schedules and daily life information at the specific date into an address allocated for the touched date region; inputting the image data on the schedules and the daily life information into the input screen by a user; storing the image data on the schedules and the daily life information written through the touchscreen into the address allocated for the touched date region; and when the present date is consistent with the date corresponding to the image data on the schedules and the daily life information, displaying the image data on a first screen of the relevant date upon display thereof.

According to the present invention, schedule input display images may be displayed in the date region in which the image data on the schedules and the daily life information are inputted.

Finally, in a case where the inputted schedules are repeated in a predetermined cycle, the method according to the present invention may further comprise the steps of: inputting the repetition cycle; determining whether a date on which the schedules are due depends on a solar calendar or a lunar calendar; calculating the next relevant date based on the repetition cycle and according to one of the solar and lunar calendars; storing the calculated date into a memory; and when the present date is consistent with the calculated date, displaying the stored schedules stored on a main screen of the touchscreen.

DETAILED DESCRIPTION FOR PREFERRED EMBODIMENT

Hereinafter, an apparatus and a method for inputting and displaying data for a refrigerator according to the present invention will be explained in detail with reference to the accompanying drawings.

Figure 1:
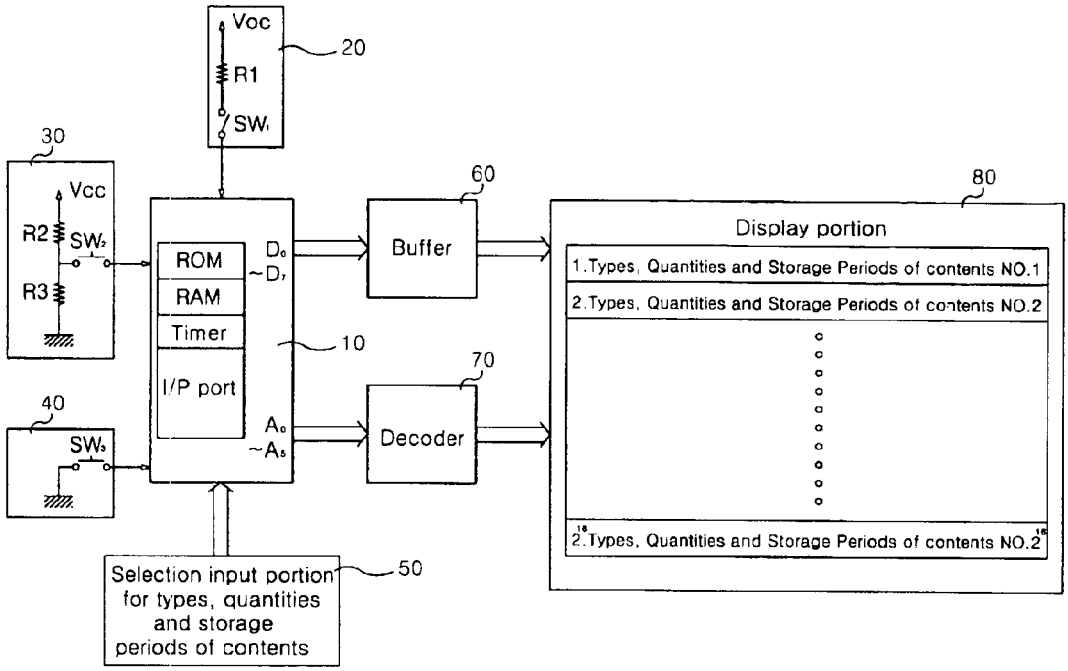
FIG. 1 is a schematic view showing the constitution for inputting and displaying data for a refrigerator according to the prior art.
Figure 2:
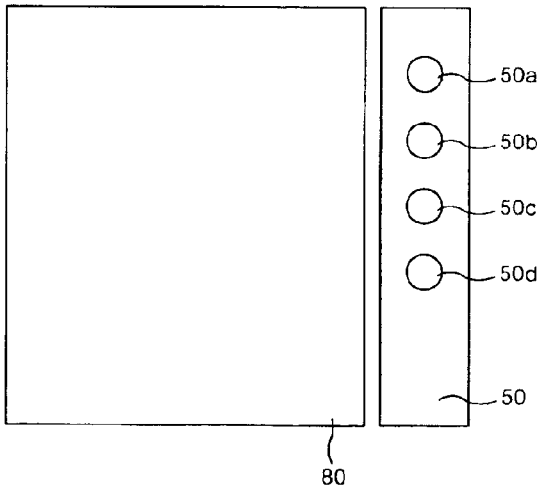
FIG. 2 is a constitutional view showing a selective input portion for inputting data according to the prior art.
Figure 3:
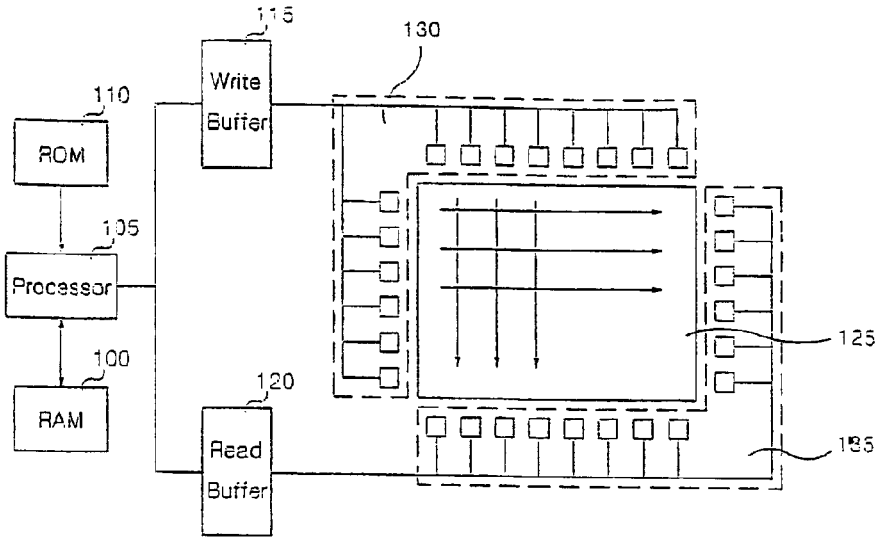
FIG. 3 is a schematic view showing the constitution for inputting and displaying data for a refrigerator according to the present invention.

FIG. 3 is a constitutional view of the apparatus for inputting and displaying data for the refrigerator according to the present invention.

As shown in this figure, a display portion 125 of a touchscreen, on which the input of writing and deleting information on stored foods can be conveniently made by a user, is provided on a front surface of the refrigerator. The touchscreen is constructed in such a manner that relevant control signals are generated by accessing software by means of an input means such as a finger, a specific pen or the like and are controlled by a processor 105, which will be described later, for processing coordinates of touch signals applied to the display portion 125 to be described later. The touchscreen is formed to include an infrared emitting portion 130 for transforming control signals generated from the processor 105 into infrared rays and outputting the infrared rays, an infrared receiving portion 135 for determining as to whether the infrared rays are generated from the infrared emitting portion 130, and the display portion 125 of the touchscreen for displaying the coordinates touched by the input means depending on whether there are infrared rays.

Further, according to another example of the touchscreen, the touchscreen may be controlled in such a manner that several resistance wires are arranged in the display portion, resistance changes generated on the resistance wires located at touched positions by static electricity of the user's finger are read, and thus the relevant touched positions can be displayed.

The processor 105 performs the controls of storing images, which the user has drawn or written on the display portion 125 of the touchscreen, into the RAM 100. Upon request of the user, it also causes the data stored in the RAM 100 to be displayed on the display portion 125 of the touchscreen. Therefore, a write buffer 115 and a readout buffer 120 for buffering writing and reading operations, respectively, are interposed between the processor 105 and the display portion 125 of the touchscreen so as to be connected to them.

In addition, the processor 105 connects the ROM 110 for storing a main program for system control with the RAM 100 for storing various kinds of data including information on the foods stored in the refrigerator, schedules and data for daily life, via data bus. Therefore, the processor 105 controls various operations of inputting and storing the data, etc. through the display portion 125 of the touchscreen based on the data stored in the ROM 110. The RAM 100 stores the information on various kinds of the foods stored in the refrigerator, the home schedules and the data for daily life. At this time, the data stored in the RAM 100 are in the form of the images which the user has drawn or written on the touchscreen.

Next, the operation of recognizing the touch signals based on touch action of the user according to the present invention having the above constitution will be briefly explained.

When predetermined control signals generated from the processor 105 are transmitted to the infrared emitting portion 130 through the write buffer 115 and the touch action is simultaneously made on a predetermined position in the display portion 125, the infrared emitting portion 130 transforms the control signals from the processor 105 into the infrared rays and emits the infrared rays to the infrared receiving portion 135 along the x and y axes. At this time, any one of data among all the infrared data emitted from the infrared emitting portion by the touch action of the user cannot be transmitted to the infrared receiving portion 135, and thus, it can be understood that specific touch action has been made on the predetermined position of the display portion 125.

In other words, the fact that all the infrared rays emitted from the infrared emitting portion 130 has reached the infrared receiving portion 135 means that any input means did not come into contact with the display portion 125. Alternatively, if the specific infrared ray does not reach the infrared receiving portion 135 although the infrared rays have been emitted thereto, it can be understood that the touch action of the user has been already made on the display portion 125.

Next, a process of inputting and displaying information on the foods stored in the refrigerator using the touchscreen according to a first embodiment of the present invention will be explained.

Figure 4:
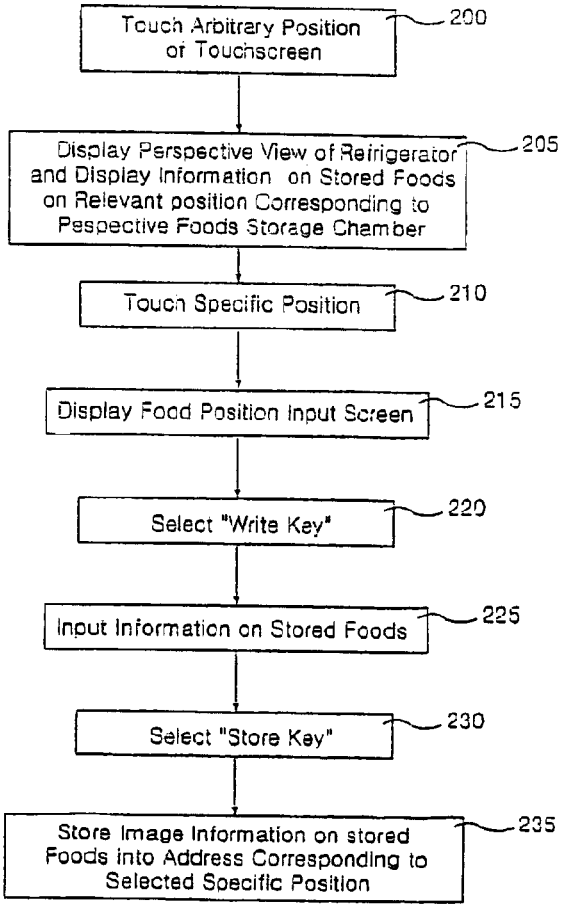
FIG. 4 is a view showing operating procedures for inputting information on foods to be stored in the refrigerator using a touchscreen according to a first embodiment of the present invention.

FIG. 4 is a view showing an operating process of inputting and displaying the information on the stored foods using the touchscreen according to the first embodiment of the present invention.

The processor 105 monitors as to whether to display the information on the foods stored in the refrigerator in a state that electric power is supplied thereto, according to a control program stored in the ROM 110 for displaying the information on the stored foods (step 200). This step 200 may be performed, for example, in such a manner that when the user touches an arbitrary position on the display portion 125 of the touchscreen, it is recognized that a command of displaying the information on the foods stored in the refrigerator has been inputted.

Figure 5:
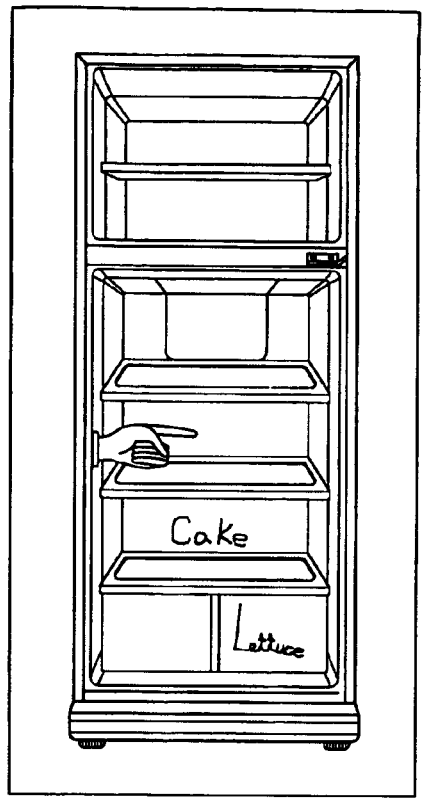
FIG. 5 is an exemplified view of a display screen of a food position displayed on the touchscreen according to the first embodiment of the present invention.

If the display command for the stored foods is inputted in step 200, the processor 105 reads out a perspective view of the refrigerator, which is stored in the RAM 100 and is similar to that as shown in FIG. 5, and displays it on the display portion 125 of the touchscreen. Simultaneously, the processor also reads out the information on the foods stored in separate addresses to the respective food storage chamber and displays the information on the relevant positions corresponding to the perspective view of the refrigerator (step 205).

The display of the food information in step 205 is performed in such a manner that image information on the stored foods is read out from the relevant addresses of the RAM 100 allocated for the selected food storage chambers and it is then displayed on the display portion 125 of the touchscreen.

Under the condition that the information on the stored foods is displayed on the display portion 125 of the touchscreen together with the perspective view of the refrigerator, the user touches a certain portion of the food storage chambers in which the foods are stored (step 210).

If the user touches, at step 210, a portion where a specific food storage chamber is illustrated, the processor 105 recognizes a set address of the food storage chamber corresponding to the portion touched by the user. Thereafter, the operation of recording information on the foods to be inputted later to the set address will be performed.

Figure 6:
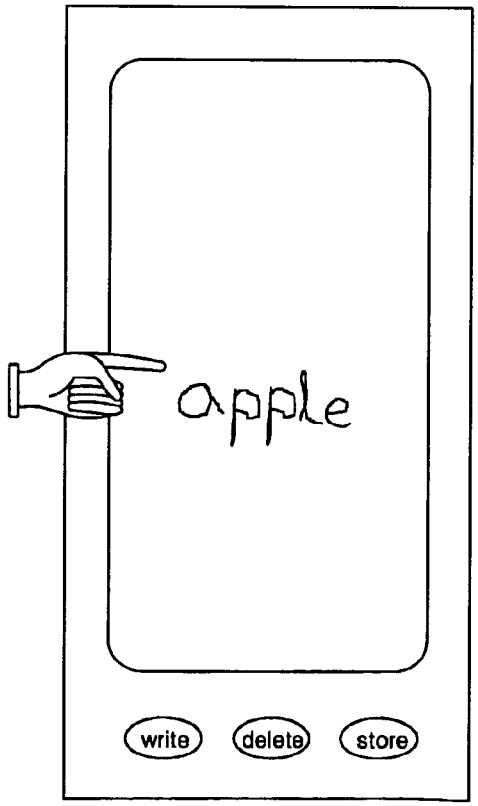
FIG. 6 is an exemplified view showing an food position input screen for inputting information on the foods to be stored in the refrigerator according to the first embodiment of the present invention.

Further, the processor 105 causes an input screen such as the screen of FIG. 6 to be displayed on the display portion 125 of the touchscreen so that the operation of recording the food information can be performed (step 215).

If the input screen is displayed on the display portion 125 of the touchscreen through step 215, the user touches down the "write key" in order to record the information on the foods put in the refrigerator (step 220).

If the "write key" is touched in step 220, the processor 105 recognizes that the food information will be written onto the display portion 125 of the touchscreen, and causes the touched position displayed on the display portion 125 of the touchscreen to be continuously displayed until the following step 230 will be performed. Therefore, the characters, which the user wants to write, are formed and displayed on the display portion under the control of the processor 105. For example, the touched position is continuously displayed until the "store key" will be selected in the following step 230 so that the user completes forming the text "apple" during step 225.

If the text "apple" is displayed on the display portion 125 of the touchscreen in step 225 and then the "store key" is selected during step 230, the processor 105 recognizes that the food information to be stored has been completed and stores the food information, which has been written on the display portion 125 of the touchscreen, into the relevant address of the food storage chamber, which has been selected in step 210 and allocated to the RAM 100 (step 235).

If the storing operation during step 235 is completed, the process is returned to a screen for displaying positions of the foods, and final information on the foods stored in the refrigerator, including the food information stored during step 235, is displayed on the display portion of the touchscreen.

On the other hand, the input of the information on the stored foods performed during step 225 is made by the operation of drawing or writing down characters or figures on the display portion 125 of the touchscreen. That is, the information on the stored foods can be recorded in a desired form. The processor 105 recognizes this information on the stored foods in the form of the images drawn on the display portion 125 of the touchscreen. Further, if the "store key" is selected in step 230, the image-typed information is stored into the previously allocated address of the RAM 100.

That is, in order to input the information on the stored foods in the refrigerator using the touchscreen according to the present invention, the food position display screen corresponding to the whole perspective view of the refrigerator (FIG. 5) is formed beforehand. The addresses for the respective parts of the refrigerator shown in FIG. 5 are also allocated to the RAM 100 beforehand. Thereafter, if the user selects the specific position on the food position display screen shown in FIG. 5, the operations of recognizing the address, which has been allocated to the RAM 100, for the specific position selected by the user and storing the inputted image-typed information on the foods into the address are performed. Then, the process is returned to an initial state and the information on the stored foods is shown to the user in the form of the perspective view of the refrigerator displayed on the touchscreen.

Furthermore, in a case where the user intends to delete information on the foods after taking out the foods from the refrigerator, he/she should also select the food storage chamber, from which the foods have been taken out, on the food position display screen. At this time, if the information on the various foods stored in the selected food storage chamber is displayed, the information on the foods located at the relevant positions can be deleted by touching the delete key and selecting the food information the user wants to delete.

Next, a process of inputting home schedules and daily life data into and displaying them on the refrigerator using the touchscreen according to a second embodiment of the present invention will be explained.

Figure 7:
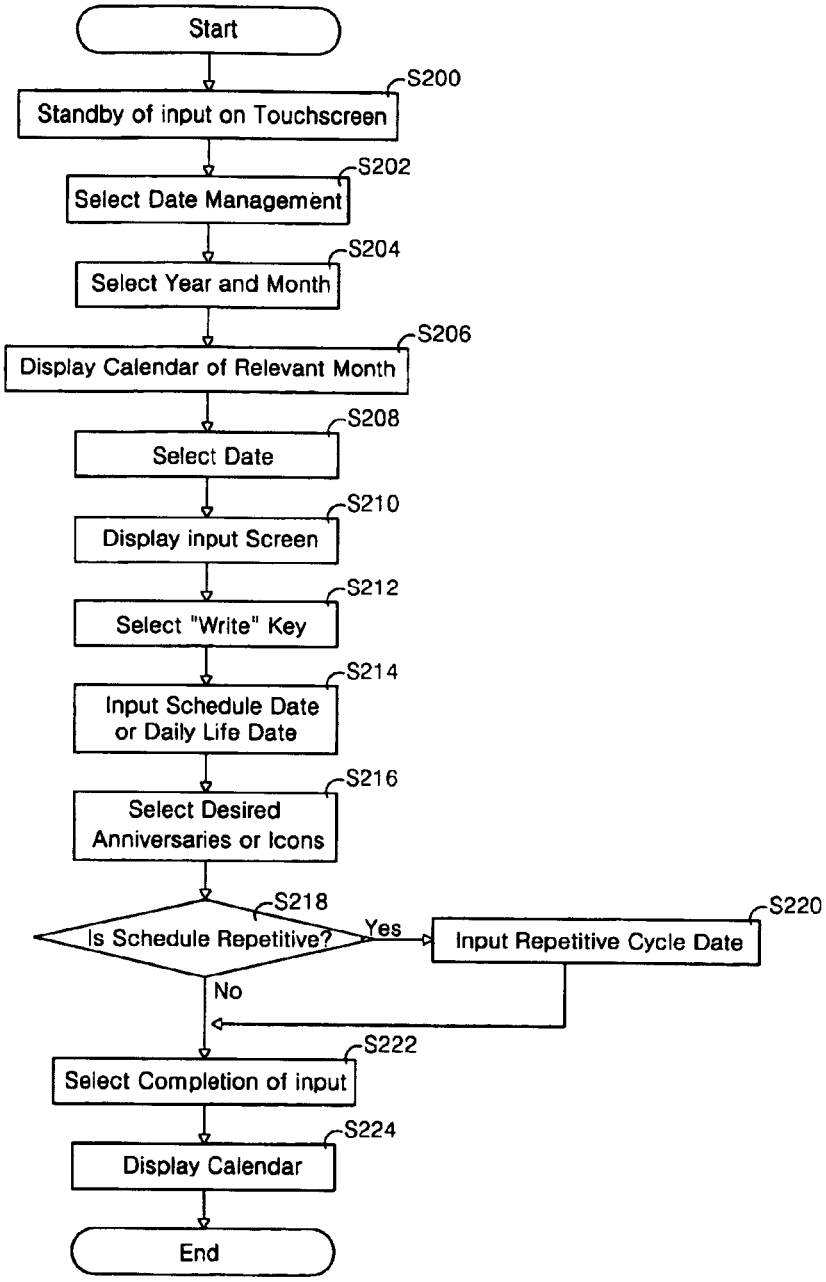
FIG. 7 is a view showing operating procedures for inputting a schedule using a touchscreen according to a second embodiment of the present invention.

FIG. 7 is an operating flowchart showing the process of inputting the home schedules and the daily life data using the touchscreen according to the second embodiment of the present invention.

The processor 105 monitors as to whether to perform the input of the schedules in a state that the electric power is supplied thereto, according to a control program stored in the ROM 110 for managing the schedules and the daily life data (step S200). This step S200 is a standby state for the input onto the touchscreen.

Figure 8:
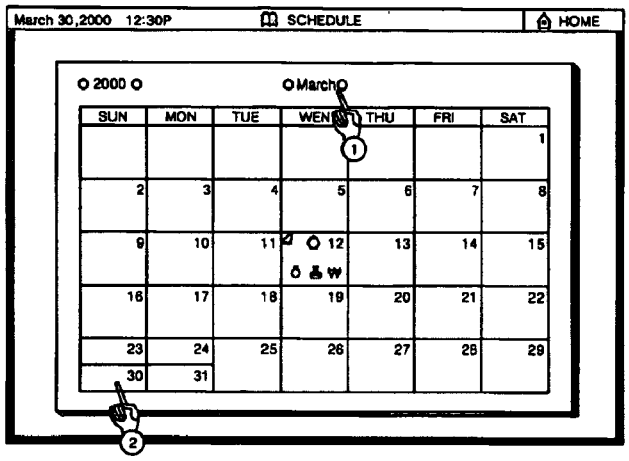
FIG. 8 is an exemplified view of a calendar screen displayed on the touchscreen according to the second embodiment of the present invention.

If the user selects a menu for schedule management in a main screen (step S202), the processor 105 displays an indication that the user should select the year and month. If the user selects the year and month (step S204), a calendar screen such as one shown in FIG. 8 is displayed on the touchscreen (step S206).

Figure 9:
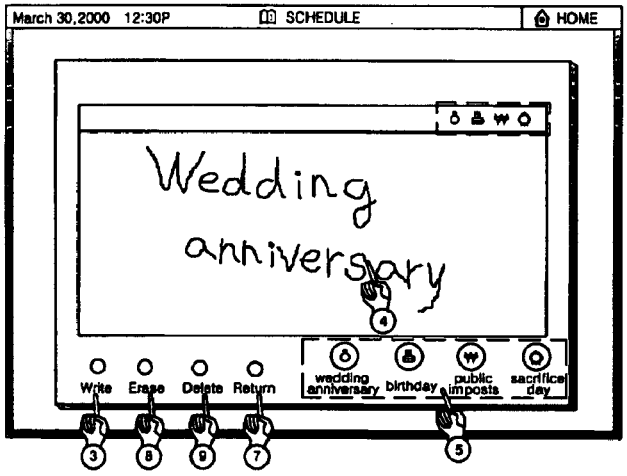
FIG. 9 is an exemplified view of a schedule input screen for inputting the schedule according to the second embodiment of the present invention.

Then, if the user selects a desired date (step S208), an input screen such as one shown in FIG. 9 is displayed (step S210). The input screen is a portion into which the user can input the schedules and data for daily life using the fingers or pens.

In this case, the user firstly selects the "write" key located at a lower left portion of the input screen (step S212) and writes down the characters on the input screen using the fingers or pens. As a result, the characters are displayed. At this time, the schedule data or daily life data are inputted here (step S214). The data inputted at step S214 are stored in the allocated address of the RAM 100 to which the selected date is assigned.

At this time, the input of the schedule data or daily life data performed at step S214 is made in such a manner that the user writes down or draws the data on the display portion 125 of the touchscreen in his/her desired forms. That is, the user does not have to input the schedule data or daily life data by means of any specific manners or rules, but can input the data in his/her desired forms. In addition, the data inputted in this manner are recognized in the form of the images by the processor 105, and the data are then stored in the allocated addresses of the RAM 100.

Next, a desired icon is selected among previously set icons in order to display a predetermined icon on the relevant dates of the calendar (step S216). That is, in this embodiment of the present invention, the icons corresponding to wedding anniversary, birthday, date of payment of the public impost, memorial service day, etc. are set like the icons displayed on the lower portion of the input screen.

Furthermore, it is determined as to whether the schedules inputted in steps S214 and S216 are repeated in a predetermined cycle (step S218). If the schedules are repetitive, repetition cycle data, such as the cycle to be repeated and which one of a lunar calendar or a solar calendar is used, are inputted (step S220).

On the other hand, when there is a need to delete some or all data during recording the data on the input screen, the user performs erasing operation by touching an "erase" key or deletes entire data by touching a "delete" key.

If the input of the schedules is completed in this manner, the input operation is completed by touching a "return" key (step S222). When the "return" key is touched, the process is returned to the calendar screen such as one shown in FIG. 8.

At this time, when the schedules has been inputted in this way, various kinds of the selected icons are displayed on a relevant date box of the calendar screen, for example, as shown in the date box of the $12^{th}$ of March in FIG. 8. Further, the date box is displayed with an edge thereof folded. The reason that it is displayed in this way is that the user can easily see the date, including the inputted schedules, as a unit of one month.

Figure 10:
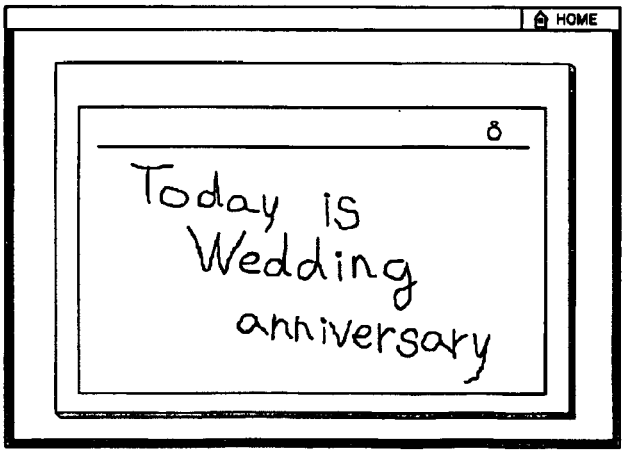
FIG. 10 is an exemplified view showing a main screen on which schedule information at a relevant date is displayed, according to the second embodiment of the present invention.

FIG. 10 shows how the schedule of the relevant date inputted in the schedule input screen is displayed according to the present invention.

That is, in order to display the schedules and daily life data on the refrigerator using the touchscreen according to the present invention, a calendar having twelve months is set beforehand. In addition, the addresses for respective date boxes shown in FIG. 8 are beforehand allocated to the RAM 100. Thereafter, if the user selects a specific date on the display screen shown in FIG. 8, the operations of recognizing the address for the selected specific date, which is allocated to the RAM 100, and of storing the data the user has inputted into the address in the form of the images are performed. Finally, if the user selects the specific date, the image data stored in the address corresponding to the specific date are read out and are then displayed on the touchscreen in the form of the images so that the data can be provided to the user.

As described in the foregoing, according to the apparatus and method for inputting and displaying the data for the refrigerator of the present invention, the information on the foods stored in the refrigerator and the schedule and daily life data can be simply recorded using the touchscreen. At this time, the data may be stored in the form of the images the user has written or drawn. Therefore, the time used for recording the data by the user can be minimized. In particular, utility of the function of recording and displaying the data on the stored foods can be improved.

Further, since the display of various languages is simplified by utilizing the touchscreen, the information on the stored foods and on the schedules can be very easily inputted as compared with the prior art in which specific alphabets should be set depending respective countries, and the data can be simply displayed based on the inputted information so that the information can be effectively provided to the user.

Accordingly, the present invention has an advantage in that the information on various data can be conveniently obtained without limitations on the function, used time and language for inputting the characters.

What is claimed is:

1. An apparatus for inputting and displaying data for a refrigerator, comprising:

a display unit provided on the refrigerator;

a touchscreen provided on an outer surface of the display unit and configured to receive image data written or drawn on the touchscreen by a user;

a memory device provided within the display unit and configured to store the image data, wherein the memory device comprises a plurality of storage areas corresponding to a respective plurality of storage chambers in the refrigerator; and a controller provided within the display unit and configured to store the image data input through the touchscreen into the memory device, and to control the touchscreen so as to display the image data on the touch screen.

2. The apparatus of claim 1, wherein the memory device is further configured to store the image data input by a user in a corresponding storage area of the memory device.

3. The apparatus of claim 1, wherein the controller comprises a processor configured to process a plurality of coordinates corresponding to a plurality of touch signals applied to the touchscreen, and to store or to retrieve corresponding information from a corresponding storage area of the memory device based on said plurality of touch signals.

4. The apparatus of claim 1, wherein the controller is further configured to delete image data from the memory device based on a touch signal applied to the touch screen.

5. The apparatus of claim 1, wherein the display unit is configured to be mounted on a front surface of the refrigerator.

6. An apparatus for inputting and displaying data for a refrigerator, comprising a display unit provided on a surface of the refrigerator;

a touchscreen provided on an outer surface of the display unit and configured to receive information on items stored in the refrigerator in the form of user generated image data;

a memory device provided within the display unit and configured to store the image data on the items stored in the refrigerator input through the touchscreen, wherein the memory device comprises a plurality of storage areas corresponding to a respective plurality of storage chambers in the refrigerator; and a controller provided within the display unit and configured to control the touchscreen and the memory device so as to display the image data on the items stored in the refrigerator on the touchscreen, and to store the image data on the items stored in the refrigerator into the memory device.

7. The apparatus of claim 6, wherein the memory device comprises a plurality of storage areas which correspond to a respective plurality of storage chambers provided in the refrigerator, and wherein the memory device is configured to store the image data on the items stored in the refrigerator in an appropriate storage area of the memory device.

8. The apparatus of claim 6, wherein the display unit is configured to be mounted on a front surface of the refrigerator.

9. The apparatus of claim 6, wherein the items stored in the refrigerator comprise food items.

10. A method for inputting and displaying data for a refrigerator in which a display unit with a touchscreen provided thereon is provided on the refrigerator and a plurality of data storage areas respectively corresponding to a plurality of storage chambers in the refrigerator are allocated in a memory device provided therein, the method comprising:

displaying the plurality of storage chambers on the touchscreen;

selecting a storage chamber from the plurality of storage chambers displayed on the touchscreen;

receiving user generated image data corresponding to items stored in the refrigerator through the touchscreen; and storing the image data in a data storage area of the memory device which corresponds to the selected storage chamber.

11. The method of claim 10, wherein displaying the plurality of storage chambers further comprises simultaneously displaying image data on the touchscreen which reflects the items which are stored in the data storage areas corresponding to the respective storage chambers.

12. The method of claim 11, further comprising allowing for selection of some image data to be deleted from the image data displayed on the touchscreen and deleting the selected image data.

13. The method of claim 10, wherein the display unit is configured to be mounted on a front surface of the refrigerator.

14. The method of claim 10, wherein the items stored in the refrigerator comprise food items.

15. A method for inputting and displaying information on a product with a display unit mounted thereon, comprising:

displaying a main menu comprising a plurality of functions on a touchscreen of the display unit, wherein the plurality of functions comprises at least a schedule management function, a perishable item management function configured to monitor a status of perishable items stored in a product on which the display unit is mounted, and a product management function;

allowing for selection of a function from the plurality of functions;

when the schedule management function is selected, displaying a calendar which corresponds to a relevant month on the touchscreen;

when a specific date of the displayed calendar is selected, providing an input screen configured to receive image data written or drawn thereon by a user and representing information related to the specific date;

receiving the image data representing information related to the specific date through the input screen;

storing the image data in a memory device provided within the display unit, wherein the memory device comprises a plurality of storage areas corresponding to a respective plurality of dates associated with the schedule management function; and displaying the stored image data on a first display screen when a present date is consistent with the specific date.

16. the method of claim 15, wherein the image data is stored into an address allocated for the specific date.

17. The method of claim 15, wherein the product comprises a home appliance.

18. The method of claim 15, wherein when information is repeated in a predetermined cycle, the method further comprises:

determining whether a date on which the information recurs depends on a solar calendar or a lunar calendar and storing an appropriate repetition cycle;

calculating a next relevant date based on the repetition cycle and one of the solar and lunar calendars;

storing the calculated date into the memory device; and when the present date is consistent with the calculated date, displaying the stored information on a main screen of the touchscreen.

19. An apparatus for inputting and displaying data on a product, comprising a display unit mounted on the product and configured to allow for input of image data generated by a user;

a touchscreen provided on an outer surface of the display unit;

a memory device provided within the display unit and configured to receive and to store the image data, wherein the memory device comprises a plurality of storage areas corresponding to a respective plurality of storage areas of the product; and a controller provided within the display unit and configured to control the memory device and the touchscreen so as to store the image information in the memory device, and to display the image information on the touchscreen.

20. The apparatus of claim 19, wherein the product comprises a refrigerator and wherein the stored items comprise perishable food items.

21. The apparatus of claim 19, wherein the image data comprises image data written by a user which represents schedule related information.

22. The apparatus of claim 21, wherein the controller is further configured to control the touchscreen and the memory device so as to allow a user to view and update schedule related information on the touchscreen.

23. The method of claim 19, wherein the image data comprises image data written by a user which represents information on items stored within the product.

* * * * *